United States Patent [19]

Sasaki

[11] Patent Number: 4,790,276

[45] Date of Patent: Dec. 13, 1988

[54] IDLING REVOLUTION CONTROL DEVICE FOR INTERNAL COMBUSTION ENGINE

[75] Inventor: Takeo Sasaki, Hyogo, Japan

[73] Assignee: Mitsubishi Denki Kabushiki Kaisha, Tokyo, Japan

[21] Appl. No.: 66,448

[22] Filed: Jun. 26, 1987

[30] Foreign Application Priority Data

Jun. 26, 1986 [JP] Japan ..... 61-150404
Jun. 26, 1986 [JP] Japan ..... 61-150405
Jun. 26, 1986 [JP] Japan ..... 61-150406

[51] Int. Cl.[4] ..... F02D 41/16
[52] U.S. Cl. ..... 123/339; 123/352
[58] Field of Search ..... 123/339, 352, 585

[56] References Cited

U.S. PATENT DOCUMENTS 4,508,076 4/1985 Oda et al. ..... 123/339
4,580,535 4/1986 Danno et al. ..... 123/339

FOREIGN PATENT DOCUMENTS .

158342 9/1984 Japan ..... 123/339

*Primary Examiner*—Tony M. Argenbright
*Attorney, Agent, or Firm*—Sughrue, Mion, Zinn, Macpeak and Seas

[57] ABSTRACT

An idle revolution of an internal combustion engine is controlled by a device which includes an average position deflection operating portion for averaging a position deflection between a predetermined position of an actuator for controlling a throttle valve of the engine and an actual position thereof over a predetermined time period to correct the predetermined position with an average value to thereby obtain a desired idle revolution of the engine. By introducing a short time position deflection into the average position deflection, which corresponds to a temporary variation of engine load, an undesired effect of such variation can be removed.

8 Claims, 10 Drawing Sheets

140 AVERAGE POSITION DEFLECTION OPERATOR
110 POSITION FEEDBACK
130 SELECT CCT.
100
150
131
132
DRIVE CONDITION JUDGE.
113
ΔP-T
ΔN-T
123
112
144
142
ΔP
143
145
141
111
P(Tw)
122
121
N(Tw)
120 REV. FEEDBACK CONTROL
6
4
5
3
1
2
7
REV. DET.
8
WATER TEMP. DET.
9
SPEED SW.

DESIRED POSITION #2
DESIRED POSITION #1
OFF
ON
NFB
PFB
t11 t12
t13
t14
FIG. 6A ACTUATOR POSITION
FIG. 6B REVOLUTION
FIG. 6C IDLE SWITCH
FIG. 6D ACTUATOR POSITION WITHOUT SHORT TIME DEFLECTION
FIG. 6E REVOLUTION WITHOUT SHORT TIME DEFLECTION
FIG. 6F SELECTION CIRCUIT

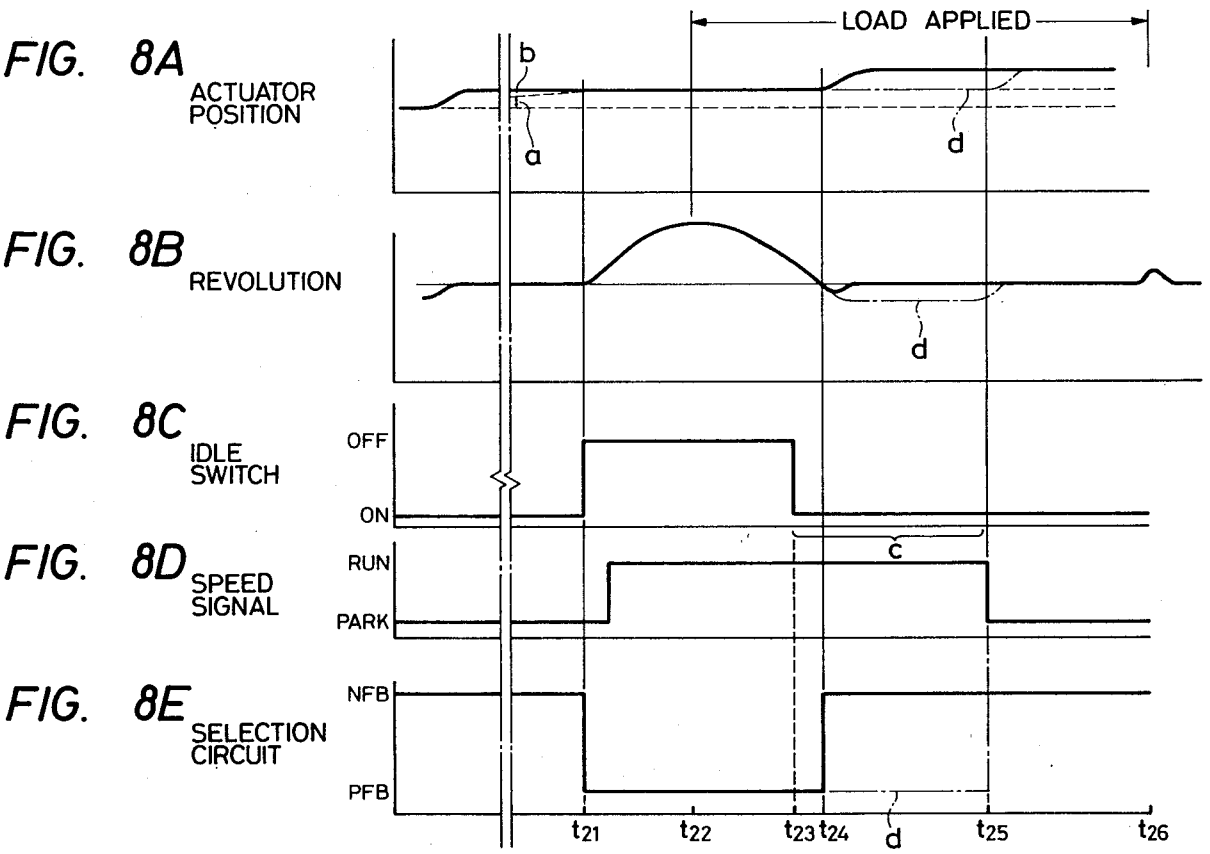
LOAD APPLIED
b
a
d
d
c
d
OFF
ON
RUN
PARK
NFB
PFB
t21
t22
t23
t24
t25
t26
FIG. 8A ACTUATOR POSITION
FIG. 8B REVOLUTION
FIG. 8C IDLE SWITCH
FIG. 8D SPEED SIGNAL
FIG. 8E SELECTION CIRCUIT ACTUATOR POSITION
a
b REVOLUTION
rpm
1000
700
DESIRED REVOLUTION

IDLE SWITCH
OFF
ON

SPEED SIGNAL
RUN
PARK

SELECTION CIRCUIT
NFB
PFB
t31
t32
t33
t34

IDLING REVOLUTION CONTROL DEVICE FOR INTERNAL COMBUSTION ENGINE

BACKGROUND OF THE INVENTION

The present invention relates to an idling revolution contol device for an internal combustion engine in which an idling revolution is controlled to a desired value by controlling an actuator which regulates a degree of opening of a throttle valve.

Such idling revolution control device in which the degree of opening of a throttle valve provided in a suction pipe of an internal combustion engine is regulated to regulate an idling revolution to a desired value functions, generally, to compare an actual revolution number of the engine with a predetermined desired revolution number and feedback-control the actual revolution number to the desired revolution number. However, at a low revolution number in such as idling condition, a time lag from a change of throttle opening to a resultant change of revolution number is large and it is very difficult to obtain a high response of revolution number when a load of the engine is abruptly changed as in a case of operation of an air-conditioner associated therewith. Therefore, it has been usual to use a detector for detecting an actual opening degree of the throttle valve and feedback-control the actual opening degree to maintain it at the desired degree.

In an engine-braking condition during a vehicle mounting the engine runs, i.e., when an accelerator is released while a transmission gear is kept meshed, the engine is driven by the vehicle itself. Therefore, the situation is much different from the idling condition although the throttle valve is in the idle position. On the other hand, in a control device having a fast idle function, a warming-up of the engine proceeds even during the vehicle runs. Therefore, an actuator for controlling an amount of intake air has to be controlled to the closing side with an increase of water temperature. In order to realize this control, a position information of the actuator is used. However, due to a variation of actuator position vs. amount of idle intake air characteristics and/or a variation of idle load engine by engine, there may be a case where the amount of air necessary under idling condition can not be obtained during the deceleration period, causing an operator to feel a lack of deceleration or the engine to stop. This is more severe when the engine is new and the friction loss is considerable.

Further, it has been very difficult to maintain a desired idle revolution when the electric load on the engine due to head lamps, braking lamps and radiator fan motor, etc. which are not considered in the idle revolution control, is changed temporarily.

SUMMARY OF THE INVENTION

An object of the present invention is to provide an idle revolution control device by which deceleration by an engine braking can be effectively performed without engine stop.

Another object of the present invention is to provide an idle revolution control device by which it becomes possible to maintain a desired idle revolution of engine even when an engine load is increased during its running condition.

According to the present invention, an idle revolution control device comprises a revolution feedback control portion for comparing an actual engine revolution with a desired revolution to control an actuator of a throttle valve so that the actual revolution comes closer to the desired revolution, an average position deflection operating portion for averaging a deflection between an actual position of the actuator when the actual revolution is converged to the desired revolution and a first desired position, a position feedback control portion for controlling the actuator in accordance with the sum of the averaged position, deflection and the desired position and a selection circuit for selecting an output of the revolution feedback control portion when the engine is in an idling condition, and an output of the position feedback control portion when the engine speed is above idling or when the vehicle is moving.

When the actual position of the actuator at a time the actual revolution is converged to the desired revolution by the revolution feedback control portion is different from the desired position, the deflection therebetween is averaged by the average position derlection operating portion and the desired position is corrected by the averaged position upon which the actuator is controlled.

The average position deflection operating portion may include a function of calculating a short time position deflection which, together with the average position deflection, is used to obtain a second desired position upon which the actuator is controlled and the selection circuit selects the output of the revolution control portion when the engine is idling while the vehicle is stopped or when the actual revolution of the engine becomes lower than the desired revolution. With such construction, it becomes possible to prevent an engine stop from occurring when the engine load is increased abruptly.

BRIEF DESCRIPTION OF THE ACCOMPANYING DRAWINGS

FIGS. 8A to 8E show time charts similar to FIG. 6, showing the operation of the embodiment in FIG. 7;

DETAILED DESCRIPTION OF THE PREFERRED EMBODIMENTS

Figure 1:
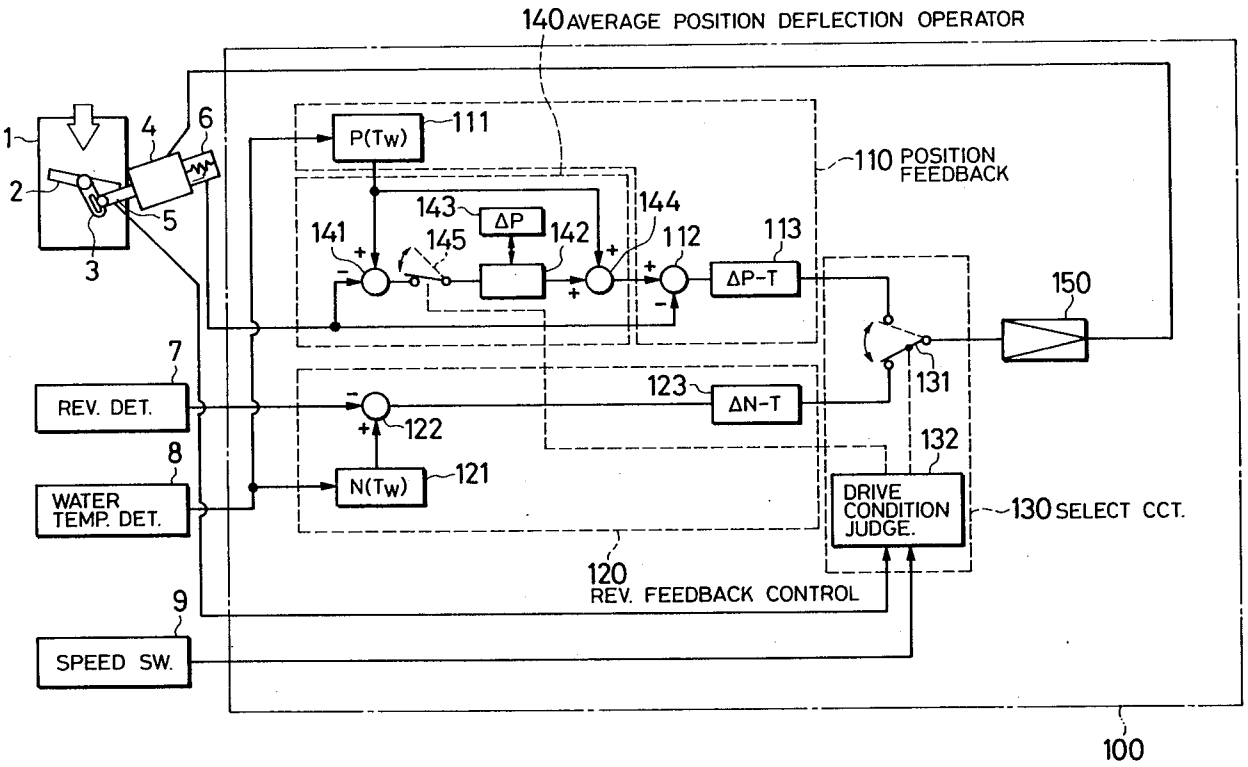
FIG. 1 is a block diagram of a first embodiment of the present invention.

Describing the present invention with reference to the accompanying drawings, FIG. 1 is a block diagram of a first embodiment of the present invention. In FIG. 1, an idle revolution control device 100 is associated with a carburetor 1 of an internal combustion engine, in which a throttle valve 2 having a lever 3 secured thereto is arranged and an actuator 4 adapted to be actuated by a d.c. motor. The actuator 4 has a rod 5 and functions to convert a rotary motion of the d.c. motor into a linear motion of the rod 5 through a suitable gear train (not shown) to thereby control the idle revolution number of the engine. The rod 5 contacts the lever 3 when the operator releases an accelerator (not shown) so that it also functions as an idle switch for providing a ground potential. An actuator position detector 6 detects a position of the rod 5. An engine revolution detector 7, a water temperature detector 8 and a vehicle speed switch 9 for determining whether or not the vehicle is moving are also associated with the present idle revolution control device 100.

The idle revolution control device 100 comprises a position feedback control portion 110 including a map memory 111 for storing a desired actuator position vs. water temperature map, a comparator 112 for comparing the desired position with an actual actuator position supplied from the actuator position detector 6 and a conversion map memory 113 for storing a conversion map between a position deflection ΔP and drive time T which determines a drive time of the actuator 4 for a position deflection obtained by the comparator 112, a revolution number feedback control portion 120 including a map memory 121 for storing a desired revolution vs. water temperature map, a comparator 122 for comparing the desired revolution number with an actual revolution number supplied from the revolution number detector 7 and a conversion map memory 123 for storing a conversion map between a revolution deflection ΔN and drive time T which determines the drive time T of the actuator 4 for the revolution deflection ΔN obtained by the comparator 122, a selection circuit 130 for selecting either of an output of the position feedback control portion 110 and an output of the revolution feedback control portion 120, which includes an exchange switch 131 and an operation condition judging portion 132, an average position deflection operating portion 140 including a comparator 141 for comparing an output of the position map memory 111 with an actual actuator position signal from the actuator position detector 6, an average operation portion 142 for averaging the output of the comparator 141 with a predetermined time constant to be described later, a non-volatile memory element 143 for storing a deflection obtained by calculation, an adder 144 for performing a summation of the averaged deflection and the desired actuator position and a switch 145 controlled by the operation condition judging circuit 132 so that it is turned on only when the averaging operation is performed, and a drive circuit 150 responsive to an output of the selection circuit 130 to supply a drive voltage to the actuator 4.

Figure 2A:
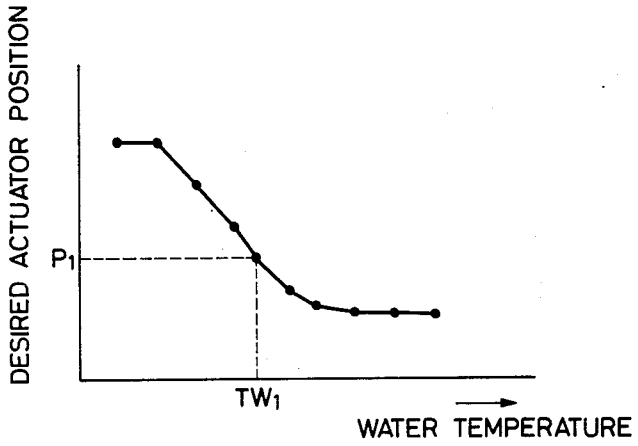
FIGS. 2A and 2B show contents of a desired actuator position map memory and a desired revolution map memory of the embodiment in FIG. 1, respectively.
Figure 2B:
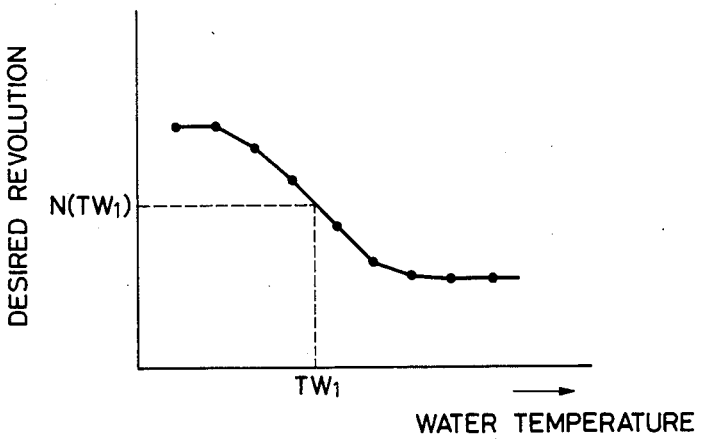

FIG. 2A shows a content of the desired actuator position vs. water temperature map memory 111 and FIG. 2B shows a content of the desired revolution vs. water temperature map memory portion 121.

Figure 3A:
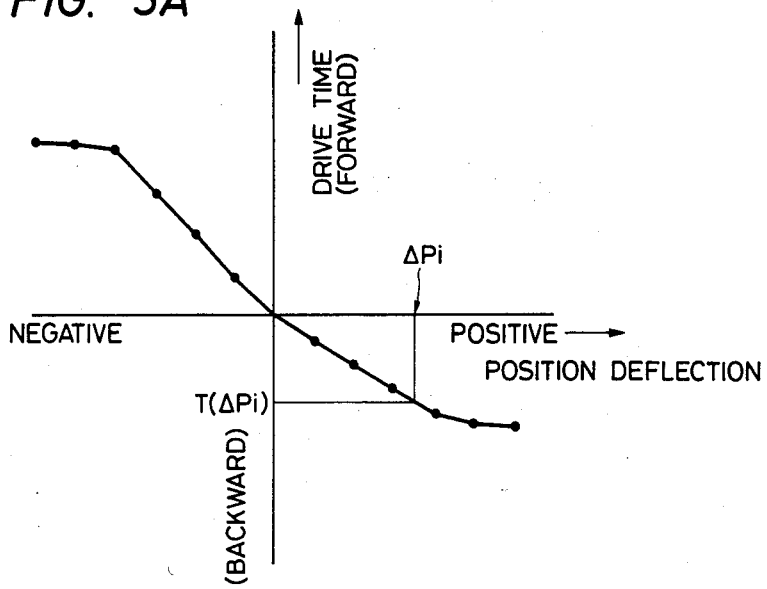
FIGS. 3A and 3B show contents of drive time conversion map memories for position deflection and for revolution deflection, respectively.
Figure 3B:
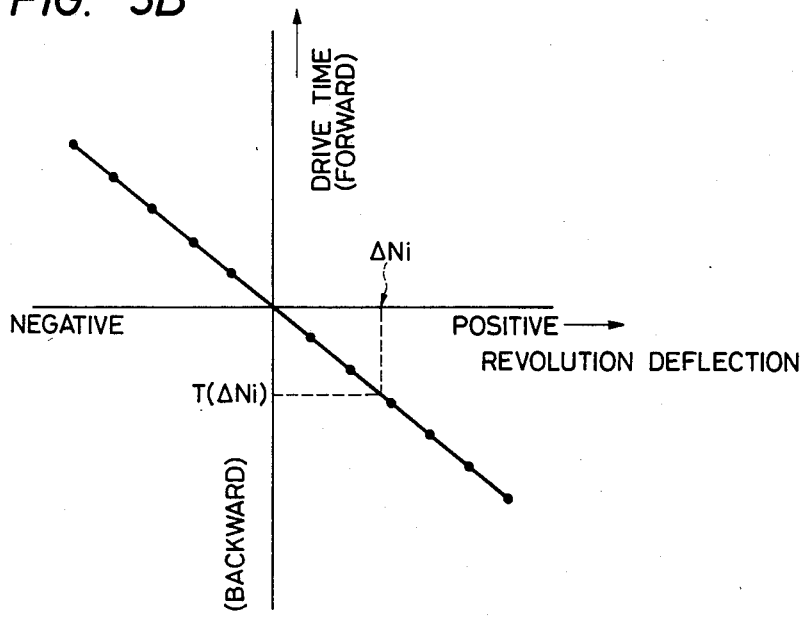

FIG. 3A shows a content of the conversion map memory portion 113 for conversion between position deflection and drive time and FIG. 3B shows a content of the drive time conversion map memory 123 for conversion between drive time and revolution deflection.

Figures 4A, 4B, 4C, 4D, 4E:
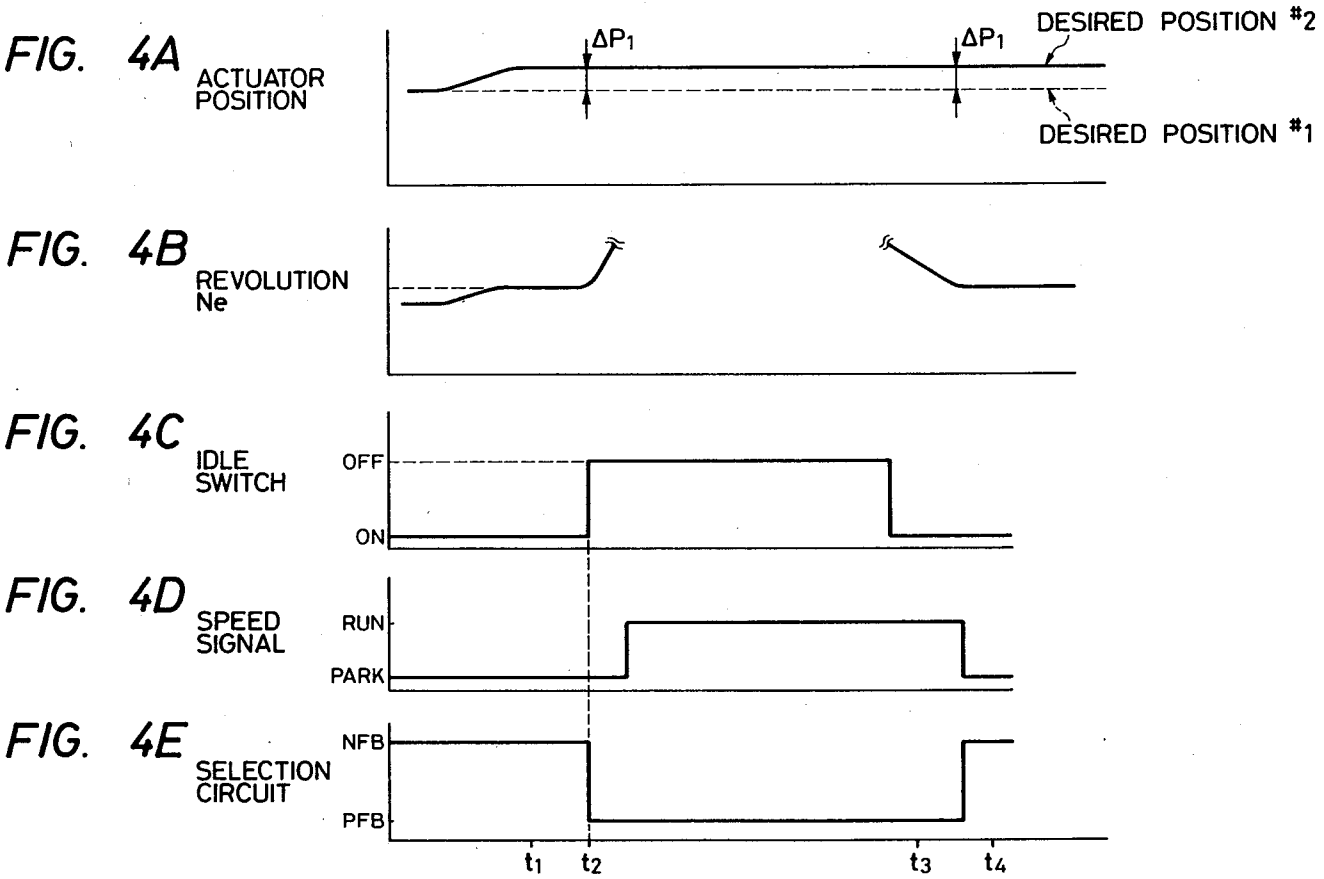
FIGS. 4A to 4E show time charts of operations of the actuator, engine, throttle valve, vehicle mounting the engine and the selection circuit in FIG. 1, respectively.

FIG. 4A is a time chart of the actuator position to be maintained, FIG. 4B is that of the engine revolution Ne under the same condition, and FIGS. 4C, 4D and 4E are a state of the idle switch for determining whether or not the thfottle valve 2 is to be in the idling condition, a vehicle speed signal indicative of a vehicle running and parking conditions and an operation mode selected by the selection circuit 130, respectively.

Describing an operation of the idle revolution control device 100 constructed as mentioned above, when the throttle valve 2 is opened by the accelerator pressed down by an operator, an amount of intake air as well as an amount of fuel supply increases correspondingly. In a case where the engine has no load, its revolution icnreases by this operation. When the accelerator is released, the throttle valve 2 is closed by a spring (not shown) and thus the amount of fuel-air mixture decreases to lower the engine revolution. In order to maintain the so-called idle revolution, it is necessary to supply fuel-air mixture in an amount corresponding thereto, which means that it is necessary to maintain a suitable degree of opening of the throttle valve. In the present invention, the idle revolution is maintained by provisions of the lever 3 fixed on the throttle shaft of the throttle valve and the actuator 4 arranged in facing relation to the lever 3, as usual. That is, the idle revolution is maintained by regulating the position of the rod 5 of the actuator to push up the lever 3 to a predetermined position.

Describing this in more detail with reference to FIGS. 4A to 4E, it is assumed that, at a time instant $t_1$, the idle switch is in a closed state. Under such condition, the operating condition judging portion 132 judges it as an idle condition of the engine and causes the exchange switch 131 to be connected to the side of the revolution feedback control portion 120. On the other hand, the desired idle revolution number corresponding to the output of the water temperature sensor 8 is stored in the desired revolution map memory 121 of the revolution number feedback control portion 120 as mentioned with reference to FIG. 2B. Therefore, when a current water temperature is represented by $T_{w1}$, the desired revolution number $N(T_{w1})$ is derived from the stored map and supplied to the comparator 122. The comparator 122 compares the desired revolution number $N(T_{w1})$ with an actual revolution number $N(t_1)$ detected by the revolution number detector 7 and sends a resultant deflection of revolution number to the revolution deflection-drive time conversion map memory 123 which stores the drive time of the actuator 4 for which the revolution deflection can be compensated for by one drive operation, as shown in FIG. 3B. The drive time for a revolution deflection ΔNi is $T_{(\Delta Ni)}$ and a voltage signal corresponding to a driving direction and the drive time is supplied to the selction circuit 130. Since the exchange switch 131 of the selection circuit 130 is connected to the revolution number feedback control portion 120 at this time, the voltage signal is transmitted through the drive circuit 150 to the actuator 4 to drive the latter for a time corresponding thereto. As a result, the rod 5 is moved to shift the throttle valve 2 through the lever 3 to thereby regulate the revolution toward the desired revolution number.

It is generally known that, during the idling operation of the engine, the time lag from the regulation of the degree of opening of the throttle valve to an attainment of the corresponding revolution is in the order of 1 second. Therefore, a subsequent comparison of revolution number is performed at a predetermined time, e.g., 1 second, after one drive operation completes to change the throttle opening correspondingly. When a further deflection exists even with the regulation, the same operation is repeated sequentially.

On the other hand, the switch 145 of the average position deflection operation portion 140 is kept closed during the revolution feedback control (NFB) operation. Therefore, a first desired position derived from the desired actuator position map memory 111 is compared in the comparator 141 with an actual position of the actuator 4 a result of which is supplied to the average operation portion 142. The map memory 111 has a content basically corresponding to the content of the desired revolution map memory 121 and stores the desired actuator position for the water temperature as shown in FIG. 2A. When the current water temperature is $T_{w1}$, the desired actuator position is $P_1$ which is supplied to the comparator 141. The average operation portion 142 averages the deflection over a time period of 30 seconds to 30 minutes and a resultant average deflection value is stored in the non-volatile memory element 143 and, at the same time, added to the position of the desired actuator position by the adder 144, which is used as a second desired actuator position.

Such averaging operation is necessary to absorb an error caused by the fact that, when the position feedback control is performed, there may be revolution deflection produced due to a possible difference between the actuator position detected by the detector 6 and an actual amount of intake air, the revolution number deflection being different from vehicle to vehicle, and to obtain the deflection not for a temporary load variation but for an average of engine load variations caused by engine warming-up operation and/or loosely connected clutch operation and/or electric load variation. Thus, the time period for the averaging operation is set to a value from about 30 seconds to about 30 minutes as mentioned above.

The non-volatile memory element 143 is connected directly to a battery of the engine, so that it holds a preceding average deflection value even after a key switch is turned off.

In a case of a new car having an engine whose operation is still not smooth, the friction loss thereof is generally large. As a result, the actual idle revolution is low even when the actuator 4 is positioned in the desired position, causing engine stalling problems to occur. According to the present invention, a car is treated as a complete new car when an electric power is supplied to the non-volatile memory element 143 firstly and a predetermined initial position deflection value is set in the memory element 143. The predetermined initial position deflection value corresponds to friction loss of the new car which corresponds to a value for providing an increase of idle revolution number by 100 to 150 rpm, generally.

The signal indicative of the second desired actuator position supplied from the adder 144 is compared in the comparator 112 of the position feedback control portion 110 with an actual position detected by the actuator position detector 6 and a resultant difference is supplied to the position deflection-drive time map memory 113 which contains the drive time of the actduator 4 for the position deflection as shown in FIG. 3A. When the position deflection is $\Delta P_i$, the drive time is given as $T_{(\Delta Pi)}$ and a voltage signal corresponding to the drive time and the drive direction is supplied to the selection circuit 130.

The exchange switch 131 of the selection circuit 130 is connected to the revolution feedback control portion 120 when the engine is in idling state. On the other hand, when the accelerator is pushed down and the idle switch is turned off thereby, the switch 131 is connected to the position feedback control portion 110.

When the idle switch is turned off at a time instant $t_2$ when the car is running, as shown in FIG. 4C, the exchange switch 131 selects the position feedback control (PFB). At the same time, the switch 145 of the average position deflection operating portion 140 is turned off and the average position deflection stored during the NFB is added to the desired position to provide the second desired position upon which the PFB is performed.

At a time instant $t_3$ within a deceleration period after the idle switch is turned on, the PFB is still performed on the second desired position. Therefore, the engine stop problem and/or the operator's feeling of lack of deceleration is removed. Further, at a time instant $t_4$ after a time at which the car is stopped and the engine thereof becomes the idling condition , the NFB is performed and the average position deflection operating portion 140 performs an averaging operation of the deflection between the desired position and an actual position.

Figure 5:
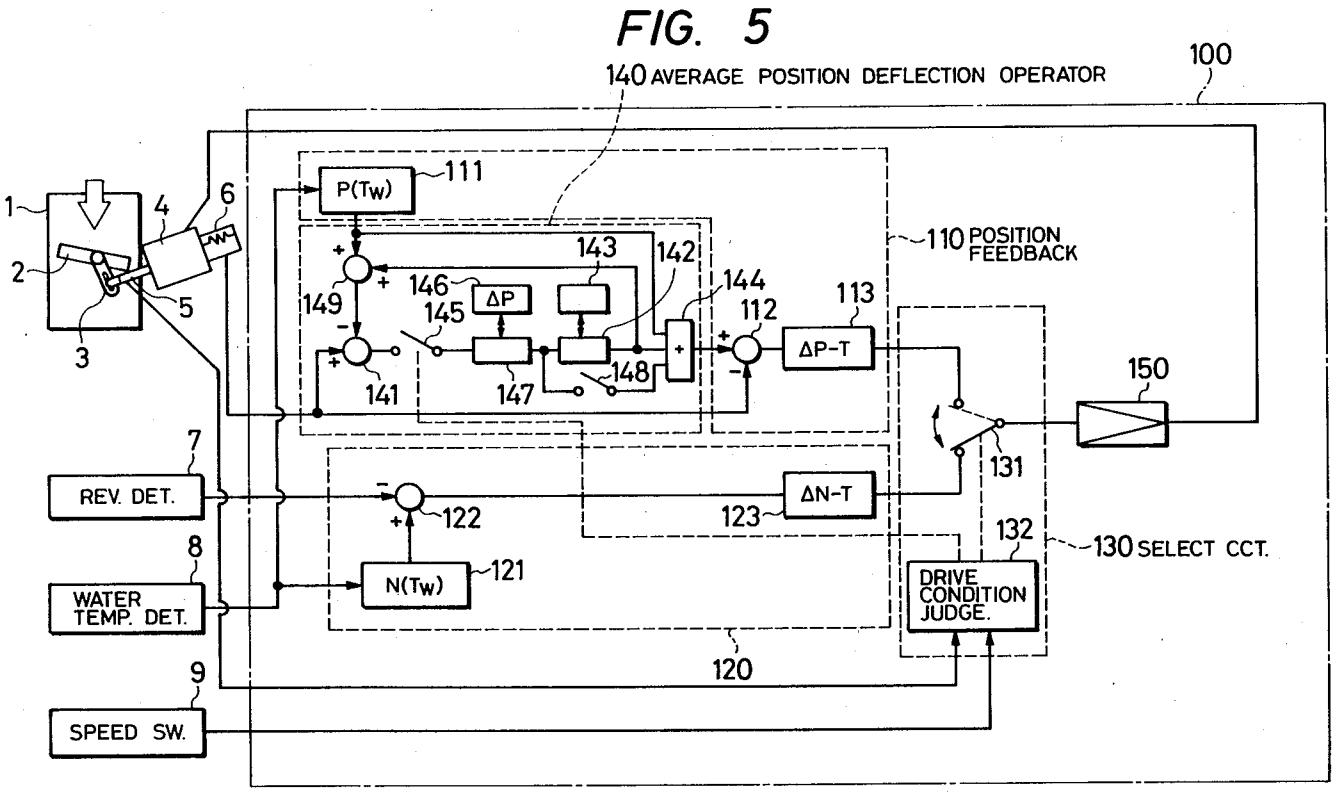
FIG. 5 is a block diagram of a second embodiment of the present invention.

FIG. 5 shows another embodiment of the present invention which is substantially the same as the first embodiment shown in FIG. 1 except the position deflection operating portion 140. The position deflection operating portion 140 of the second embodiment includes, additionally, a short time deflection operating circuit 147, a non-volatile memory element 146, a switch 148 for selectively bypassing the average deflection operating circuit 144 and an adder 149.

Describing an operation of the embodiment in FIG. 5 with reference to FIGS. 6A to 6F, at a time instant $t_{11}$ within a time period in which the vehicle is parked with the idle switch being on, the operating condition judging portion 132 decides it as an idlling condition and switches the exchange switch 131 onto the side of the revolution feedback control portion 120. Therefore, the desired revolution number from the revolution map memory 121 is supplied to the comparator 122. Subsequent operations are the same as those described with reference to the embodiment in FIG. 5.

Figure 6:
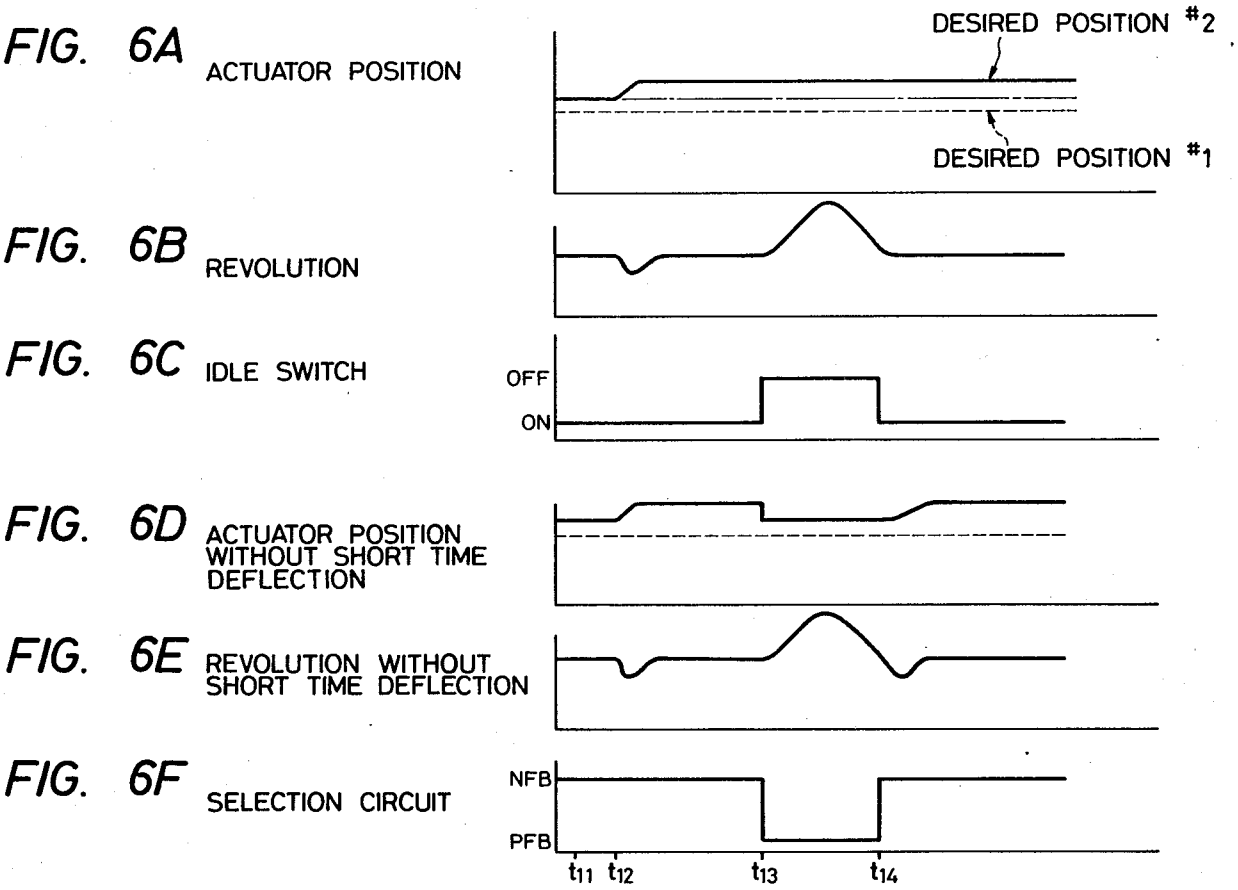
FIGS. 6A to 6F show time charts similar to FIG. 4, showing the operation of the embodiment in FIG. 5.

When any load is applied to the engine at a time instant $t_{12}$, the engine revolution is temporarily lowered as shown in FIG. 6B. Since, at this time, the engine is being controlled on the NFB, the actuator is controlled toward throttle open side and thus the engine rotation is maintained at the desired idle revolution.

When, at a time instant $t_{13}$, the accelerator is pushed down and the idle switch is turned off, the switch 131 is switched to the position feedback control side and thus the PFB is performed. At this time, the switch 145 is turned off by the judging portion 132 and a learning operation of the average position deflection is terminated, so that the short time position deflection and the average position deflection stored in the memory elements 143 and 146 are added to each other by the adder 144 to provide a second desired actuator position signal which is sent to the comparator 112. The comparator 112 compares this signal with an actual position signal from the detector 6 and a difference therebetween is stored in the position deflection drive time conversion map memory 113.

A drive time signal from the memory 113 is supplied through the selection circuit 130 to the driver 150 to control the actuator 4.

When, at a time instant $t_{14}$, the accelerator is released and the idle switch is turned on, the engine revolution is lowered gradually and the control is switched to the NFB. However, since the actuator position is being regulated to the second desired position, there is no such reduction of engine revolution as shown in FIG. 6E which is unavoidable if there is no short time position deflection given, resulting in a revolution curve shown in FIG. 6B. That is, if the control is performed with only the average position deflection, the actuator position becomes the desired position added by the average position deflection at the time instant $t_{13}$ as shown in FIG. 6D, which does not reflect the load increment. This may provide no problem in the case where the idle switch is in the off state since the engine revolution depends on the degree of throttle opening. However, until the engine operation is returned to the idle condition at a time instant $t_{14}$ and the engine revolution is stabilized at the predetermined value by the NFB, the engine rotation may be lowered. This phenomenon is repeated every time when the accelerator is released and the engine becomes in the idle state.

In this embodiment, the switch 148 is turned off during the vehicle is running to avoid the summation of the short time position deflection. With this construction, an application of short position deflection for such as half-clutch operation which provides a large increment of load to the engine can be avoided.

Conditions under which the switch 148 is turned off may be the engine revolution above a predetermined value, e.g., 1000 rpm. In such case, it is possible to restrict the revolution variation of the engine in idle condition so long as the engine revolution is not more than 1000 rpm even if the vehicle is running.

Figure 7:
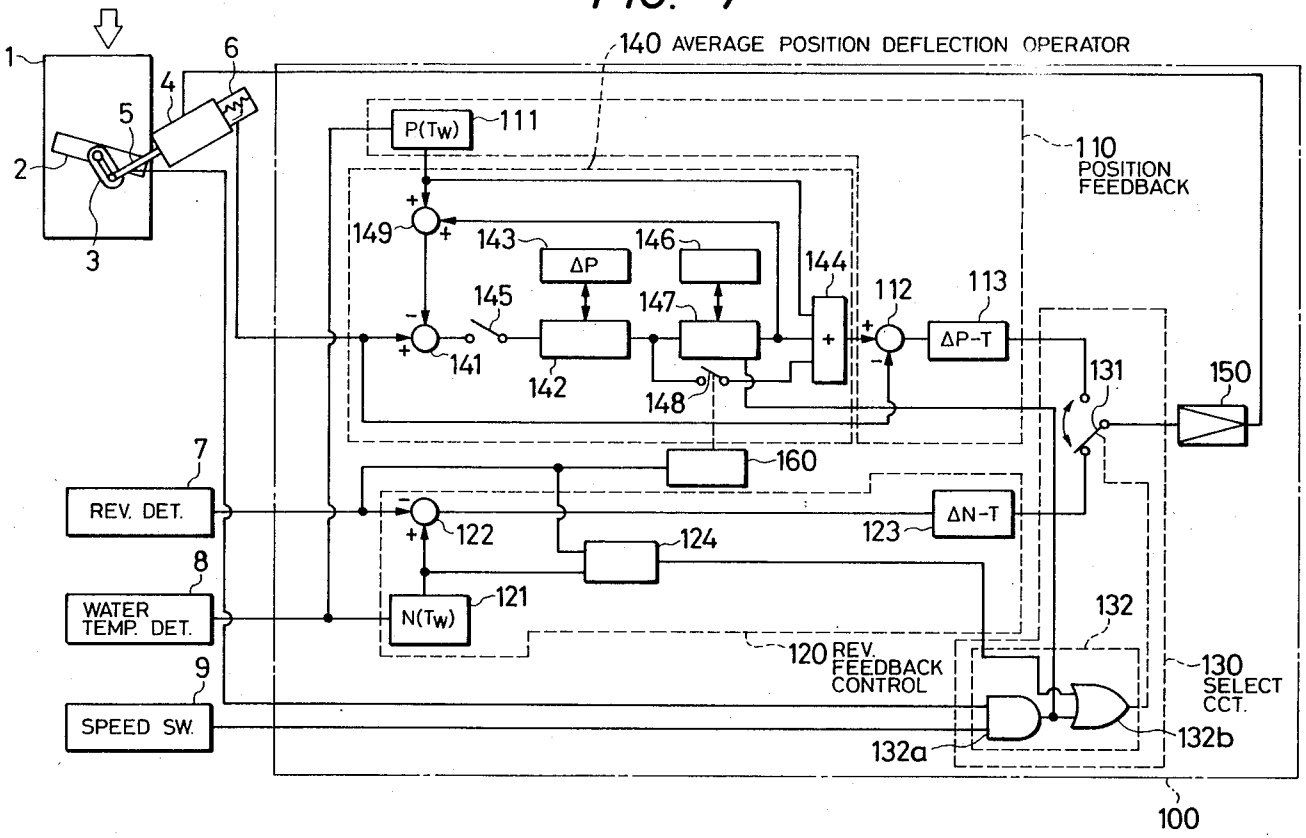
FIG. 7 is a block diagram of a third embodiment of the present invention.
Figures 9A, 9B, 9C, 9D, 9E:
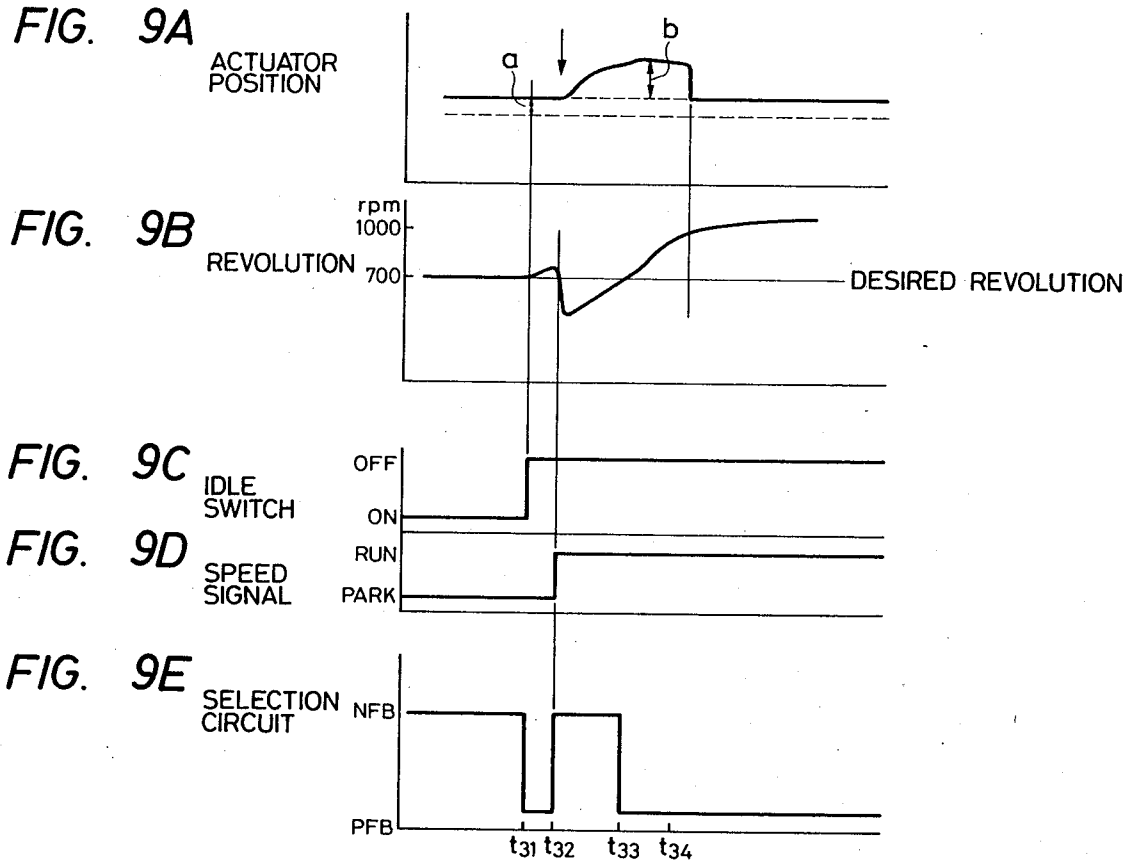
FIGS. 9A to 9E show time charts of the operation of the embodiment in FIG. 7 under a different condition.

FIG. 7 shows a third embodiment of the present invention, which is the same as that shown in FIG. 5 except a provision of a first revolution judging portion 124 and a second revolution judging portion 160 which turns the switch 148 off when the actual engine revolution becomes higher than 1000 rpm.

The first revolution judging portion 124 serves to compare the actual engine revolution from the revolution number detector with the desired revolution from the map memory 121 and provides an output when the latter is higher than the actual revolution.

In this embodiment, the selection circuit 132 comprise an AND gate **132*a* having inputs connected to the idle switch and the vehicle speed switch 9, respectively, and an OR gate 32*b* having inputs connected to an output of the first judging portion 124 and an output of the AND gate 132*a*. An output of the OR gate 132*b* is associated with the switch 131 to turn it on the side of the revolution feedback control portion 120** when it is "H".

The overall operation of this embodiment is substantially the same as that of the embodiment shown in FIG. 5 and, therefore, an operation which is unique over the latter embodiment will be described.

In FIGS. 8A to 8E, the vehicle is parked before a time instant $t_{21}$ in which the average deflection operating portion 147 averages the difference between the actual revolution and the desired revolution as shown by a letter a in FIG. 8A until the short time position deflection b becomes zero.

When the accelerator is actuated at the time instant $t_{21}$ and the idle switch is turned off as shown in FIG. 8C, the switch 131 is switched on the side of the position feedback control portion 110 to perform the PFB as mentioned previously.

When a load such as electric load is applied to the engine at a time instant $t_{22}$, the actuator position is unchanged due to the PFB control and thus the engine revolution depends on the degree of throttle opening. Assuming that, at a time instant $t_{23}$, the accelerator is released and the idle switch is turned on by which the engine is disconnected from driving wheels of the vehicle while the latter continues to run for a time period c in FIG. 8C until a time instant $t_{25}$ at which the vehicle stops to run and that, at a time instant $t_{24}$ before the time instant $t_{25}$, the revolution number becomes lower than the desired revolution as shown in FIG. 8B, the first revolution judging portion 124 provides the output signal by which the output of the OR gate **132*b* becomes "H" and thus the switch 131 is connected to the side of the revolution feedback control portion 120 regardless of the state of the idle switch and the vehicle running condition. Therefore, the actuator position is added by the load increment by which the engine revolution is immediately regulated to the desired value. In FIGS. 8A and 8B, chain lines b show curves in these figures when there is no revolution judging portion 124 provided. That is, without the revolution judging portion 124**, the PFB control is performed since the vehicle is running at the time instant $t_{24}$ and therefore the actuator position is unchanged so that the revolution is lowered by an amount corresponding to the load increment, this being continued until the time instant $t_{25}$. Then, when the load increment is removed at $t_{25}$, the revolution is stabilized at the predetermined value after a slight increase due to the NFB control performed.

FIGS. 9A to 9E are time charts of operation of the third embodiment when the vehicle is started with the half-clutch condition. Assuming that the accelerator is actuated at a time instant $t_{31}$ and the idle switch is turned off and then that the clutch is half-connected at a time instant $t_{32}$, the selection circuit 130 selects the revolution feedback control portion 120 when the engine revolution is lowered below the desired value, e.g., to 700 rpm. Thus, the actuator position is regulated toward the throttle open side to increase the revolution. And, when it reaches the desired revolution at a time instant $t_{33}$, the control is switched to the PFB and the actuator position at $t_{33}$ becomes the value which is the sum of the average position deflection a and the short time position deflection b in FIG. 9A. In this case, however, since the deflection b is different from the correction amount for the increase of engine load, the engine revolution may increase abnormally when the actuator position is corrected by the sum. This problem is solved by turning the switch 148 off by the second revolution judging portion 160 when the revolution at a time instant $t_{34}$ exceeds 1000 rpm so that the short time position deflection b is reset.

Figure 10:
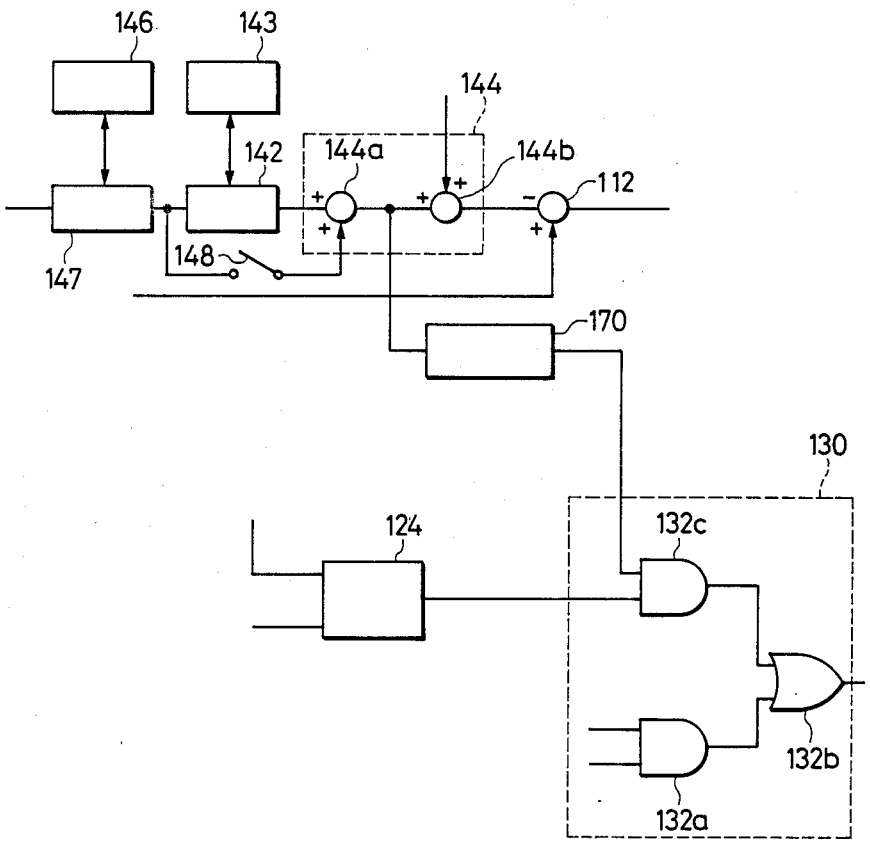
FIG. 10 is a portion of a fourth embodiment of the present invention.

FIG. 10 shows another embodiment of the present invention by which the NFB control is prohibited when the sum of the average positoin deflection and the short time position deflection obtained by the position deflection operating portion 140 is not less than a predetermined value.

In this embodiment, the selection circuit 130 further comprises an AND gate **132*c* connected between the output of the first revolution judging portion 124 and the OR gate 132*b* in FIG. 7. The other input of the OR gate 132*c* is connected through an open degree judging portion 170 to a junction between adders 144*a* and 144*b*** which constitute the adder 144. The open degree judging portion 170 serves to judge whether or not an output of the adder 144*a* is not more than a predetermined value. The adder 144*b* serves to add the output of the adder 144*a* to the output of the actuator position map memory 111.

The NFB control is performed when the idle switch is turned on while the vehicle is parked as well as when the actual engine revolution is not more than the desired value. In these cases, the learned value, i.e., the sum of the short time position deflection and the average position deflection, is limited to a value not more than a predetermined value. The open degree judging portion 170 provides an "H" output when the learned value is not more than the predetermined value and an "L" output when it is not less than the predetermined value. Therefore, when the learned value is not less than the predetermined value, the output of the AND gate 132*c* becomes "L" and the OR gate 132*b* prohibits the NFB control when the vehicle is not parking. This is because, when the learned value exceeds the predetermined value, there may be some engine abnormality and thus the NFB control is prevented.

As described hereinbefore, according to the present invention, the actuator is controlled by correcting the desired position thereof with an average value of deflection between the actual position and the desired position. Therefore, the deceleration of vehicle can be performed without engine stop problem while providing an enough deceleration feeling to an operator.

Further, by incorporating the short time position deflection to the correction, there is no abnormal variation of engine revolution even when the engine load is changed temporally, so that the idle revolution can be maintained at the predetermined value.

In addition, by employing the revolution feedback control when the actual revolution of engine is lowered below the desired value, there is no reduction of revolution of idling engine even when a load is added to the engine during the vehicle is running.

What is claimed is:

1. An idle revolution control device for an internal combustion engine associated with a revolution detector for detecting engine revolution, an idle detector for detecting an engine condition in which a throttle valve is not opened, an actuator for controlling an amount of intake air during an idling condition of the engine, and an actuator position detector for detecting a drive position of said actuator and adapted to control said actuator according to information from at least said revolution detector, said idle detector and said actuator position detector, said idle revolution control device comprising:

a revolution number feedback control portion for comparing a predetermined revolution number with an actual revolution number from said revolution number detector and for controlling said actuator to control an amount of intake air of said engine in an idling condition so that said actual revolution number converges to said predetermined revolution number;

an average position deflection operating portion for averaging a position deflection between a first predetermined position of said actuator and an actual position thereof when said actual revolution number becomes equal to said predetermined revolution number over a predetermined time period;

a position feedback control portion for adding an averaged position deflection obtained by said average position deflection operating portion to said first predetermined position of said actuator to obtain a second position of said actuator to which the actual position of said actuator is controlled;

a selection circuit for selecting an output of said revolution number feedback control portion when said throttle is in the idle condition and an output of said position feedback control portion when said engine is out of idle condition or a vehicle mounting said engine is moving; and a drive portion for driving said actuator according to an output of said selection circuit to force said actuator to said second position.

2. The idle revolution control device as claimed in claim 1, wherein said time period for averaging said position deflection is from about 30 seconds to about 30 minutes.

3. The idle revolution control device as claimed in claims 1 or 2, wherein said average position deflection obtained by said average position deflection operating portion is kept stored in a memory element even when an ignition key of said engine is in an off state.

4. The idle revolution control device as claimed of claims 1 or 2 wherein said average position deflection operating portion operates to provide an initial average position deflection value corresponding to a position in which intake air is increased by an amount corresponding to an idle load variation experienced when a battery of the vehicle is initially connected thereto.

5. The idle revolution control device as claimed in claim 1, wherein said average position deflection operating portion further operates to calculate a short time position deflection and said second position of said actuator is set as a sum of average position deflection and said short time position deflection.

6. The idle revolution control device as claimed in claim 5, wherein said summation of said short time position deflection to said average position deflection is stopped when the vehicle is moving.

7. The idle revolution control device as claimed in claim 5, wherein said summation of said short time position deflection to said average position deflection is stopped when engine revolution is not less than 1000 rpm.

8. The idle revolution control device as claimed in any of claims 5 to 7, wherein said revolution feedback control is prohibited when a result of said summation is not less than a predetermined value.

* * * * *